US008667645B2

(12) United States Patent
Smith

(10) Patent No.: US 8,667,645 B2
(45) Date of Patent: Mar. 11, 2014

(54) ATTACHMENT GLIDER

(75) Inventor: Matthew Smith, Wooster, OH (US)

(73) Assignee: Waxman Consumer Products Group Inc., Bedford Heights, OH (US)

( * ) Notice: Subject to any disclaimer, the term of this patent is extended or adjusted under 35 U.S.C. 154(b) by 0 days.

(21) Appl. No.: 13/491,703

(22) Filed: Jun. 8, 2012

(65) Prior Publication Data

US 2013/0139351 A1 Jun. 6, 2013

Related U.S. Application Data

(60) Provisional application No. 61/495,102, filed on Jun. 9, 2011.

(51) Int. Cl.
*A47B 91/06* (2006.01)

(52) U.S. Cl.
USPC ..... 16/42 R

(58) Field of Classification Search
USPC ..... 16/42 R, 42 T; 248/188.9, 188.4, 188.2, 248/346.11
See application file for complete search history.

(56) References Cited

U.S. PATENT DOCUMENTS

| | | | | | |
|---|---|---|---|---|---|
| 1,208,546 | A * | 12/1916 | Hachmann | 248/188.9 |
| 1,804,437 | A * | 5/1931 | Rice | 16/42 R |
| 1,849,570 | A * | 3/1932 | Duncan, Jr. | 248/188.9 |
| 1,954,130 | A * | 4/1934 | Higgins | 16/42 R |
| 1,981,728 | A * | 11/1934 | Harris | 16/42 R |
| 2,206,120 | A * | 7/1940 | Peterson | 248/188.4 |
| 2,283,978 | A * | 5/1942 | Eberle | 16/42 R |
| 2,584,295 | A * | 2/1952 | Sanzenbacher | 99/419 |
| 2,953,180 | A * | 9/1960 | Kyles | 269/54.5 |
| 3,183,545 | A * | 5/1965 | Bergstrom | 16/42 R |
| 5,081,740 | A * | 1/1992 | Smith | 16/42 R |
| 5,557,824 | A | 9/1996 | Bushey | |
| 6,869,052 | B2 * | 3/2005 | Keast et al. | 248/188.9 |
| 7,231,690 | B2 | 6/2007 | Bushey | |
| 2011/0191985 | A1 * | 8/2011 | Hirth | 16/42 R |

FOREIGN PATENT DOCUMENTS

| | | | |
|---|---|---|---|
| EP | 733323 | A1 * | 9/1996 |
| FR | 2762496 | A1 * | 10/1998 |

* cited by examiner

*Primary Examiner* — Chuck Mah

(74) *Attorney, Agent, or Firm* — Tarolli, Sundheim, Covell & Tummino LLP

(57) ABSTRACT

An attachment glider comprises an engagement surface having an adhesive plane for securing to an object. The attachment glider further comprises a plurality of attachment spikes extending from the engagement surface at an angle transverse to the adhesive plane and a supporting surface for nesting a fixture coupled to the attachment spikes. The fixture is positioned between the engagement surface and the supporting surface.

27 Claims, 6 Drawing Sheets

ATTACHMENT GLIDER

CROSS REFERENCES TO RELATED APPLICATIONS

The following application claims priority to U.S. Provisional Patent Application Ser. No. 61/495,102, filed Jun. 9, 2011 entitled ATTACHMENT GLIDER. The above-identified application is incorporated herein by reference in its entirety for all purposes.

TECHNICAL FIELD

The present disclosure relates to an attachment glider, and more particularly, an attachment glider that is secured to an object to be moved such that the attachment glider is located between the object and the flooring in which the object is to be moved.

BACKGROUND

In the moving industry, it is quite usual to face the situation of having to move large, heavy, and sometimes awkwardly shaped objects such as furniture within the confines of buildings. The movement of large objects and furniture are not limited to the venue of commercial buildings, but equally experienced in residential settings with interest in relocating furniture to achieve a new floor plan or moving the furniture or large objects to a new home. Other occurrences arise from office downsizing, team wiring upgrades, etc. that frequently mandate office reconfigurations requiring that the furniture be moved or rotated. Furniture is also frequently moved for example, in healthcare and educational facilities for cleaning. In these instances, as in the installation of modular carpet, it is desirable to move the furniture quickly, with the least possible effort and, preferably, after hours with a limited number of workers.

Office equipment is usually moved with a hand truck, four-wheel dolly, or the like and can take several individuals working together. The work is hard, labor expensive and injuries occur. Other furniture, such as workstations, computers, etc. are also difficult to move. The preferable method of moving the heavy objects is for professional movers to pick the object up and carry it by hand, but this is not always an economically feasible or a possible arrangement because of the lack or cost of labor.

SUMMARY

One example embodiment of the present disclosure includes an attachment glider comprising an engagement surface having an adhesive plane for securing to an object. The attachment glider further comprises a plurality of attachment spikes extending from the engagement surface at an angle transverse to the adhesive plane and a supporting surface for nesting a fixture coupled to the attachment spikes. The fixture is positioned between the engagement surface and the supporting surface.

Another example embodiment of the present disclosure includes an attachment glider comprising an engagement surface having an adhesive plane for securing to an object and a plurality of attachment spikes extending from the engagement surface at an angle transverse to the adhesive plane. The attachment glider also includes an intermediate surface for supporting a fixture coupled to the plurality of attachment spikes. The fixture is positioned between the engagement surface and the intermediate surface. The attachment glider further comprises a transport surface positioned opposite the engagement surface, the intermediate surface being positioned between the engagement surface and the transport surface.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout unless otherwise noted. The present disclosure relates to an attachment glider, and more particularly, an attachment glider that is secured to an object to be moved such that the attachment glider is located between the object and the flooring in which the object is to be moved.

Figure 1:
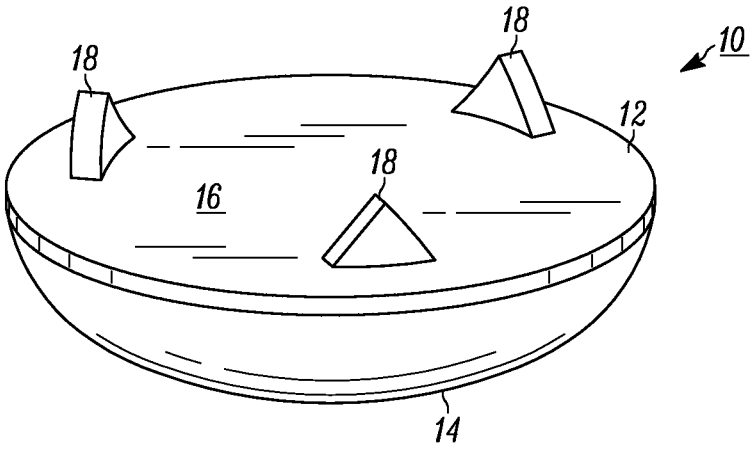
FIG. 1 is perspective view of an attachment glider constructed in accordance with one example embodiment of the present disclosure.

FIG. 1 illustrates a perspective view of an attachment glider 10 constructed in accordance with one example embodiment of the present disclosure. The glider 10 includes an engagement surface 12 for attaching to an object such as furniture and transport surface or support surface 14 for contacting the floor on which the object is located. The glider 10 is fixedly attached to form a secured connection to an object (not shown) such as a furniture leg through the combination of an adhesive bond 16 located on the engagement surface 12 and plurality of attachment spikes 18 fixed to the glider and projecting away from the engagement surface.

The transport surface 14 is located opposite the engagement surface 12 and designed to protect the floor from marring or damage during movement of the object across the surface of the floor. In the illustrated example embodiment, the engagement surface 12 and transport surface 14 are circularly shaped, but could be constructed to include any geometrical shape to match the geometry portion of the object in which the glider is secured without departing from the spirit and scope of the present disclosure.

Figure 2:
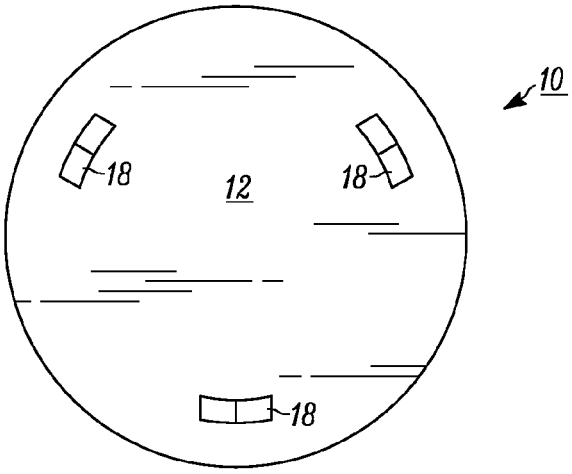
FIG. 2 is a top plan view of FIG. 1.
Figure 3:
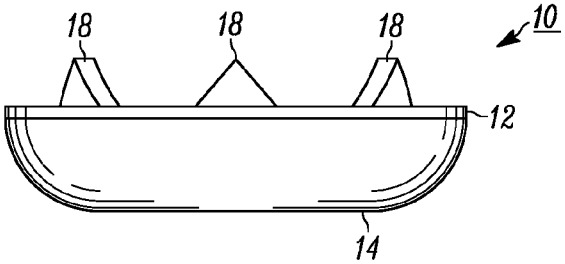
FIG. 3 is a side elevation view of FIG. 1.
Figure 4:
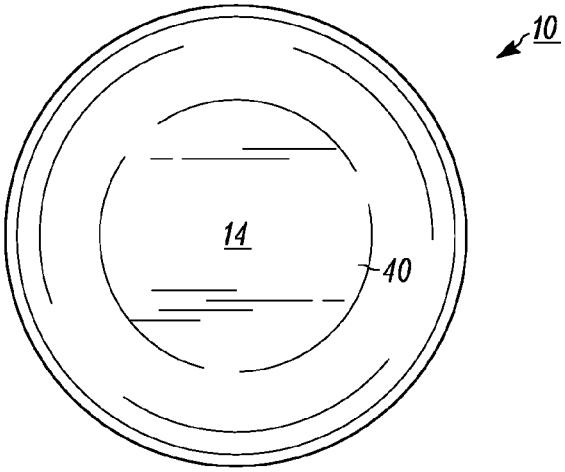
FIG. 4 is a bottom plan view of FIG. 1.
Figure 5:
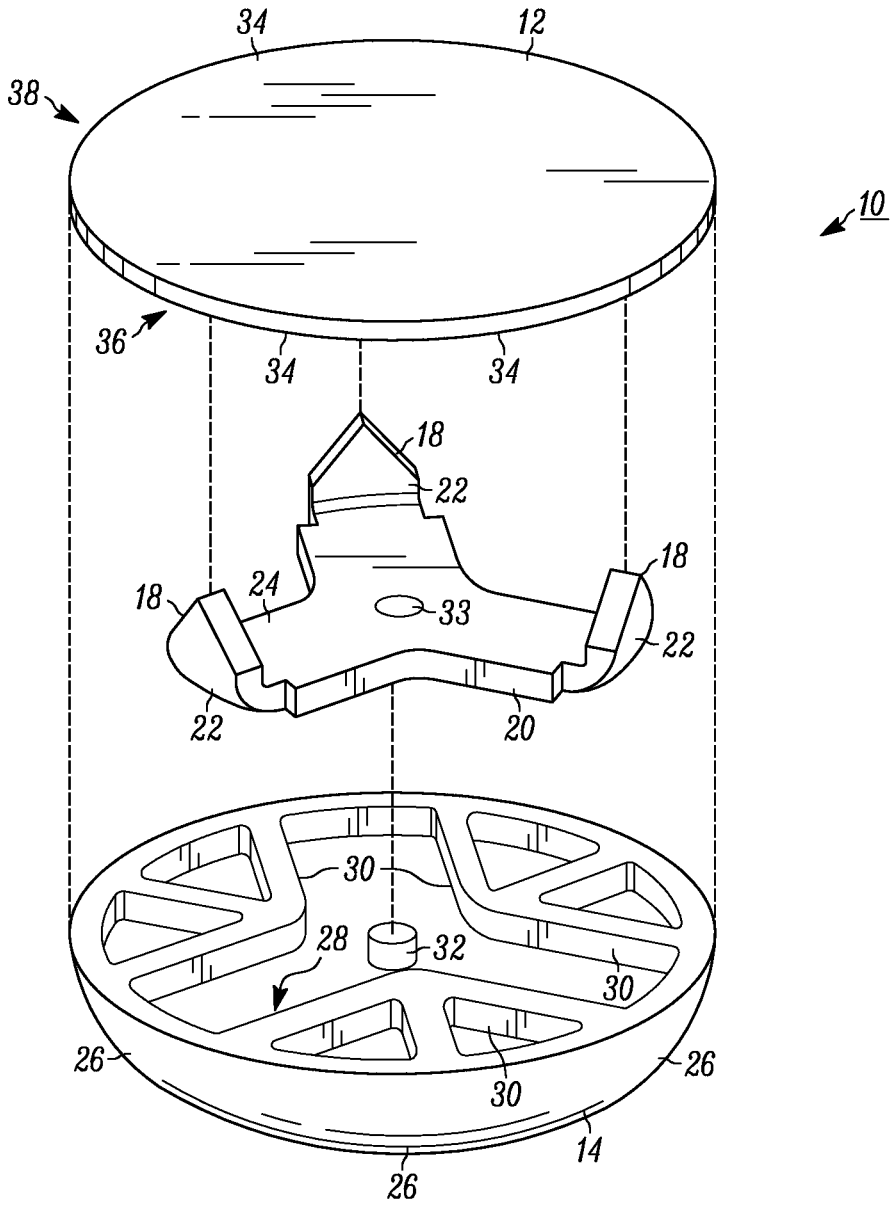
FIG. 5 is an exploded perspective view of FIG. 1.

Illustrated in FIGS. 2-4, are the top plan, side elevation, and bottom plan views of the example embodiment of FIG. 1. FIG. 5 illustrates an exploded perspective view of the example embodiment of FIG. 1. In particular, the transport surface 14 supports a metal fixture 20 having a plurality of transversely curved ends 22 extending from a relatively planer body 24. The transversely curved ends 22 support a respective one of the plurality of attachment spikes 18.

In one example embodiment, the transport surface 14 is a circular cup having an upwardly curved radial wall 26 supporting a cavity region 28. The cavity region 28 includes a number of support walls 30 for retaining the metal fixture 20 and to advantageously prevent the metal fixture from rotating or moving within the cavity during use. The number support walls 30 correspond to the number of curved ends 22. The cavity 28 further comprises an alignment projection 32 for guiding the metal fixture 20 having a corresponding opening 33 into the cavity during assembly.

Once the metal fixture 20 is seated into the cavity 28, the engagement surface 12 is positioned over the metal fixture and secured to the transport surface 14. That is, the engagement surface 12 comprises a double-sided adhesive plane 34, allowing for adhesive bonding to both an assembly side 36 and engagement side 38 of the engagement surface. In the illustrated example embodiment, the engagement surface is approximately 1/32" of one-inch thick and both sides 36, 38 include a protective sheet to cover the adhesive surface that is removed upon assembly or attachment to the object.

In addition to the adhesive bond, the plurality of attachment spikes penetrate the engagement surface 12 during assembly. This penetration assists in the securing of the engagement surface 12 to the transport surface 14.

In the illustrated example embodiment, the transport surface 14 is molded from a thermoplastic of relatively hard properties and the metal fixture 20 is formed from 1020 steel. The transport surface 14 further comprises a contact area 40 for engaging the floor that has a relatively smooth low friction surface advantageous for efficient transport of the object across a floor. In the illustrated example embodiment of FIGS. 1-5, the attachment glider 10 is particularly suitable for carpet floors.

The plurality of attachment spikes 18 protrude from the attachment surface 12 approximately 1/16" of one inch and include a total of three located equally at 120 degrees from each other. This allows for securing to the object for transport, such as a wooden leg of furniture without the need of a hammer or tools. While the penetration of the spikes 18 are advantageously designed in size and configuration to eliminate the need for tools, the spikes' 18 design and configuration in combination with the adhesive bond of the adhesive plane 34 provide sufficient strength to resist separation after attachment, shear stresses, or failure during transport of the object.

Figure 6:
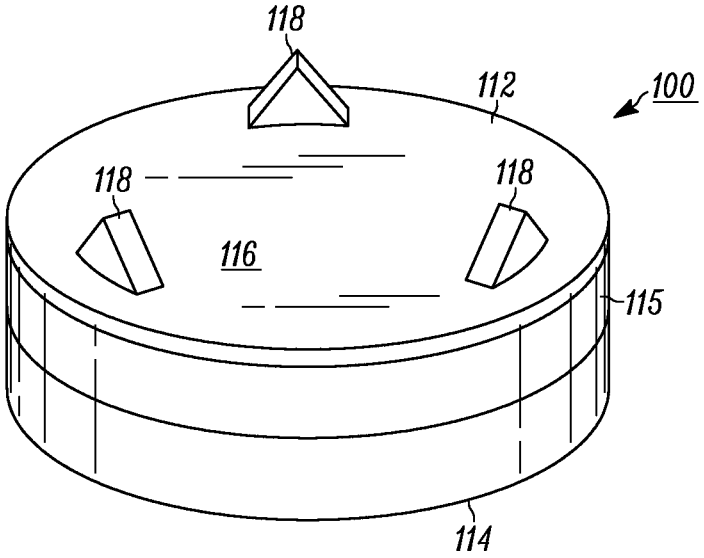
FIG. 6 is a perspective view of an attachment glider constructed in accordance with another example embodiment of the present disclosure.

FIG. 6 illustrates a perspective view of an attachment glider 100 constructed in accordance with another example embodiment of the present disclosure. The glider 100 includes an engagement surface 112 for attaching to an object such as furniture and transport surface 114 for contacting the floor on which the object is located. The glider 100 is fixedly attached to form a secured connection to an object (not shown) such as a furniture leg through the combination of an adhesive bond 116 located on the engagement surface 112 and plurality of attachment spikes 118 fixed to the glider and projecting away from the engagement surface.

The transport surface 114 is located opposite the engagement surface 112 and designed to protect the floor from marring or damage during movement of the object across the surface of the floor. In the illustrated example embodiment, the engagement surface 112 and transport surface 114 are circularly shaped, but could be constructed to include any geometrical shape to match the geometry portion of the object in which the glider is secured without departing from the spirit and scope of the present disclosure.

Figure 7:
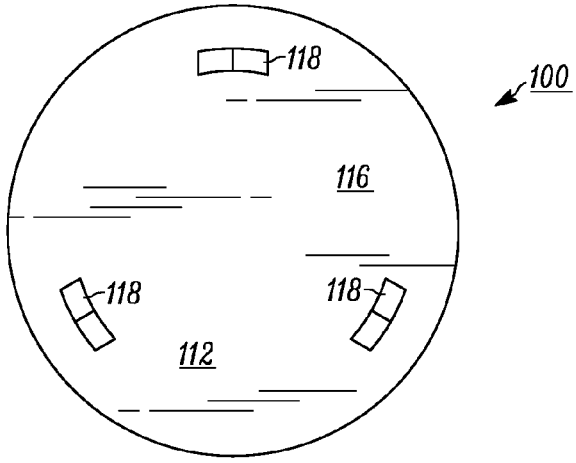
FIG. 7 is a top plan view of FIG. 6.
Figure 8:
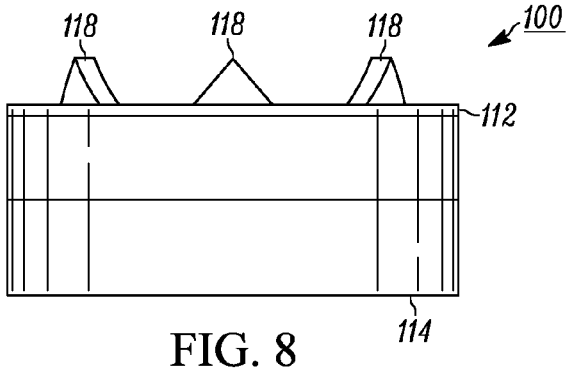
FIG. 8 is a side elevation view of FIG. 6.
Figure 9:
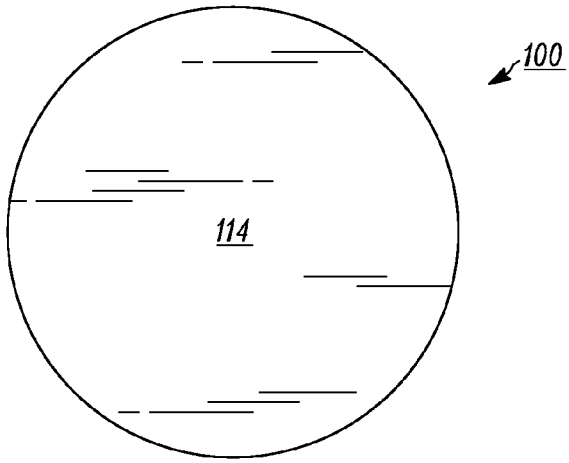
FIG. 9 is a bottom plan view of FIG. 6.
Figure 10:
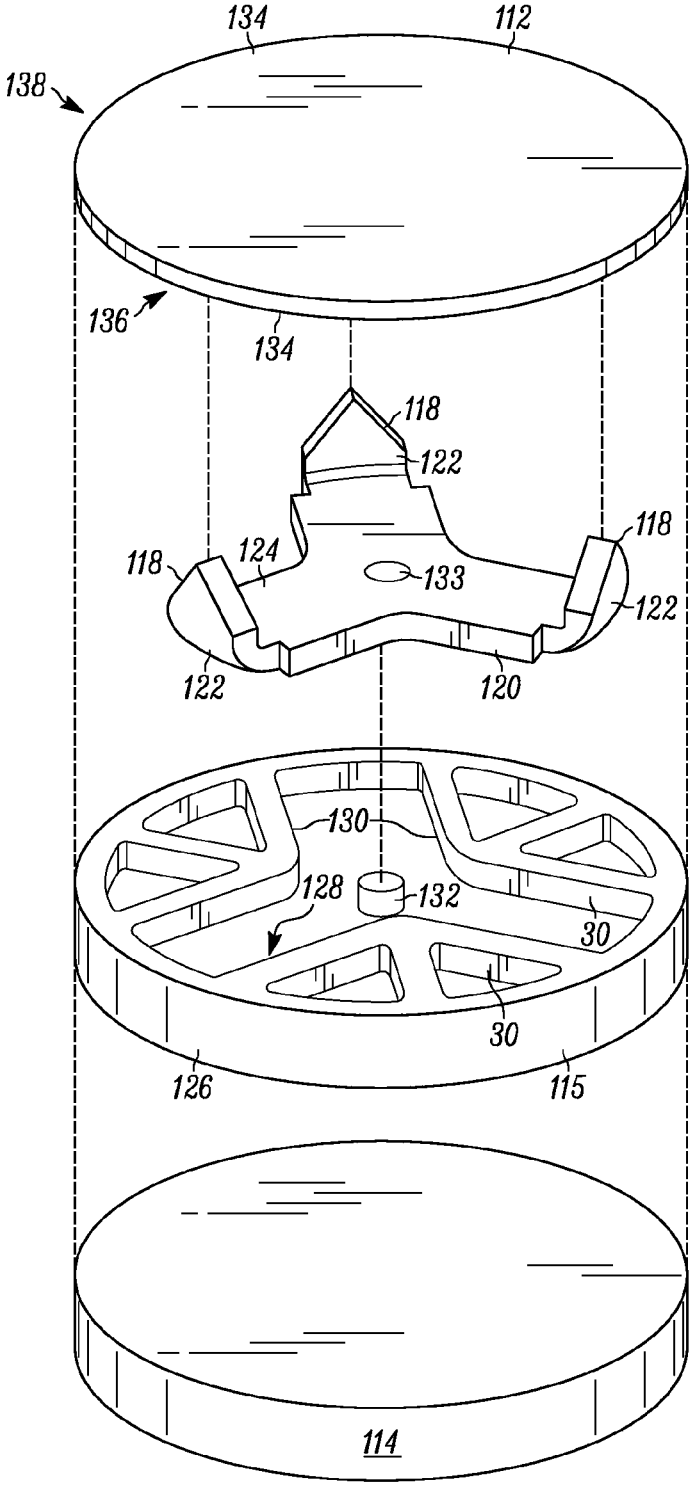
FIG. 10 is an exploded perspective view of FIG. 6.

Illustrated in FIGS. 7-9, are the top plan, side elevation, and bottom plan views of the example embodiment of FIG. 6. FIG. 10 illustrates an exploded perspective view of the example embodiment of FIG. 6. In particular, the engagement surface 112 and transport surface 114 are separated by an intermediate surface 115. The intermediate surface 115 supports a metal fixture 120 having a plurality of transversely curved ends 122 extending from a relatively planer body 124. The transversely curved ends 122 support a respective one of the plurality of attachment spikes 118.

In one example embodiment, the intermediate surface 115 is a circular disc having a radial wall 126 supporting a cavity region 128. The cavity region 128 includes a number of support walls 130 for retaining the metal fixture 120 and to advantageously prevent the metal fixture from rotating or moving within the cavity during use. The number support walls 130 correspond to the number of curved ends 122. The cavity 128 further comprises an alignment projection 132 for guiding the metal fixture 120 having a corresponding opening 133 into the cavity during assembly.

Once the metal fixture 120 is seated into the cavity 128, the engagement surface 112 is positioned over the metal fixture and secured to the intermediate surface 115. That is, the engagement surface 112 comprises a double-sided adhesive plane 134, allowing for adhesive bonding to both an assembly side 136 and engagement side 138 of the engagement surface. In the illustrated example embodiment, the engagement surface 112 is approximately 1/32" of one-inch thick and both sides 136, 138 include a protective sheet to cover the adhesive surface that is removed upon assembly or attachment to the object.

In addition to the adhesive bond, the plurality of attachment spikes 118 penetrate the engagement surface 112 during assembly. This penetration assists in the securing of the engagement surface 112 to the intermediate surface 115. The intermediate surface 115 is secured to the transport surface 114 by an adhesive, such as glue positioned and cured between the surfaces. In an alternative example embodiment, another engagement surface 112 is positioned between for securing the intermediate surface 115 to the transport surface 114.

In the illustrated example embodiment, the transport surface 114 is a soft textile material, such as felt approximately 1/8" of one inch in thickness and the metal fixture 120 is formed from 1020 steel. The intermediate surface 115 is molded from a relatively hard thermoplastic. In the illustrated example embodiment of FIGS. 6-10, the attachment glider 100 is particularly suitable for non-carpet floors, such as wood, laminate, vinyl, tile, and the like.

The plurality of attachment spikes 118 protrude from the attachment surface 112 approximately 1/16" of one inch and include a total of three located equally at 120 degrees from each other. This allows for securing to the object for transport, such as a wooden leg of furniture without the need of a hammer or tools. While the penetration of the spikes 118 are advantageously designed in size and configuration to eliminate the need for tools, the spikes' 118 design and configuration in combination with the adhesive bond of the adhesive plane 134 provide sufficient strength to resist separation after attachment, shear stresses, or failure during transport of the object.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. An attachment glider comprising:

an engagement surface having an adhesive plane for securing to an object;

a plurality of attachment spikes extending from the engagement surface at an angle transverse to said adhesive plane; and a supporting surface and a fixture supported by the supporting surface, the plurality of attachment spikes extending from the fixture and extending through the engagement surface, said fixture being positioned between said engagement surface and said supporting surface, the supporting surface defining a cavity region including a plurality of support walls for retaining the fixture.

2. The attachment glider of claim 1 wherein the fixture includes a plurality of transversely curved ends, each of the plurality of transversely curved ends supporting a respective one of the plurality of attachment spikes.

3. The attachment glider of claim 2 wherein the plurality of transversely curved ends of the fixture extend from a planar body.

4. The attachment glider of claim 2 wherein the supporting surface defines a cavity region includes an upwardly curved radial wall supporting the cavity region.

5. The attachment glider of claim 4 wherein a number of support walls of the plurality of support walls is equal to or greater than a number of the plurality of transversely curved ends of the fixture.

6. The attachment glider of claim 5 wherein each of the plurality of transversely curved ends of the fixture supports a respective one of the plurality of attachment spikes and further wherein each of the plurality of support walls of the supporting surface cavity region receive, in nested relationship, a respective one of the plurality of transversely curved ends of the fixture.

7. The attachment glider of claim 4 wherein the cavity region of the supporting surface includes an alignment projection and the fixture includes a body defining an opening, the alignment projection of the supporting surface extending into the opening of the fixture body.

8. The attachment glider of claim 1 wherein each of the plurality of attachment spikes penetrate through and extend outwardly from the engagement surface to assist in securing the engagement surface to the supporting surface.

9. The attachment glider of claim 1 wherein the engagement surface defines a assembly side and an engagement side and the adhesive plane comprises a double-sided adhesive plane, a first adhesive plane being defined by the assembly side of the engagement surface and a second adhesive plane being defined by the engagement side of the engagement surface.

10. The attachment glider of claim 9 wherein the first adhesive plane of the assembly side of the engagement surface includes an adhesive bond for securing the engagement surface to the supporting surface.

11. The attachment glider of claim 9 wherein the second adhesive plane of the engagement side of the engagement surface includes an adhesive bond for securing the engagement surface to an object.

12. The attachment glider of claim 1 wherein the supporting surface includes a contact area at an opposite end of the attachment glider from the engagement surface, the contact area defining a smooth, low friction surface.

13. The attachment glider of claim 1 wherein a number of the plurality of attachment spikes is three and each of the plurality of attachment spikes extend from the engagement surface a distance of substantially 1/16".

14. An attachment glider comprising:

an engagement surface having an adhesive plane for securing to an object;

a plurality of attachment spikes extending from the engagement surface at an angle transverse to said adhesive plane;

an intermediate surface and a fixture supported by the intermediate surface, the plurality of attachment spikes extending from the fixture and extending through the engagement surface, said fixture being positioned between said engagement surface and said intermediate surface, the intermediate surface defining a cavity region including a plurality of support walls for retaining the fixture; and a transport surface positioned opposite the engagement surface, the intermediate surface being positioned between the engagement surface and the transport surface.

15. The attachment glider of claim 14 wherein the fixture includes a plurality of transversely curved ends, each of the plurality of transversely curved ends supporting a respective one of the plurality of attachment spikes.

16. The attachment glider of claim 15 wherein the plurality of transversely curved ends of the fixture extend from a planar body.

17. The attachment glider of claim 15 wherein the intermediate surface includes a radial wall supporting the cavity region.

18. The attachment glider of claim 17 wherein a number of support walls of the plurality of support walls is equal to or greater than a number of the plurality of transversely curved ends of the fixture.

19. The attachment glider of claim 18 wherein each of the plurality of support walls of the cavity region of the intermediate surface each receive, in nested relationship, a respective one of the plurality of transversely curved ends of the fixture.

20. The attachment glider of claim 17 wherein the cavity region of the intermediate surface includes an alignment projection and the fixture includes a body defining an opening, the alignment projection of the intermediate surface extending into the opening of the fixture body.

21. The attachment glider of claim 17 wherein the transport surface includes a contact area at an opposite end of the attachment glider from the engagement surface, the contact area defining a smooth, low friction surface.

22. The attachment glider of claim 14 wherein each of the plurality of attachment spikes penetrate through and extend outwardly from the engagement surface to assist in securing the engagement surface to the intermediate surface.

23. The attachment glider of claim 14 wherein the engagement surface defines a assembly side and an engagement side and the adhesive plane comprises a double-sided adhesive plane, a first adhesive plane being defined by the assembly side of the engagement surface and a second adhesive plane being defined by the engagement side of the engagement surface.

24. The attachment glider of claim 23 wherein the first adhesive plane of the assembly side of the engagement surface includes an adhesive bond for securing the engagement surface to the intermediate surface.

25. The attachment glider of claim 23 wherein the second adhesive plane of the engagement side of the engagement surface includes an adhesive bond for securing the engagement surface to an object.

26. The attachment glider of claim 14 wherein a number of the plurality of attachment spikes is three and each of the plurality of attachment spikes extend from the engagement surface a distance of substantially 1/16".

27. The attachment glider of claim 14 wherein the intermediate surface is secured to the engagement surface by an adhesive.

* * * * *